US005141395A

United States Patent [19]

Carroll et al.

[11] Patent Number: 5,141,395

[45] Date of Patent: Aug. 25, 1992

[54] FLOW ACTIVATED FLOWPATH LINER SEAL

[75] Inventors: Michael D. Carroll, West Chester; Mark S. Rocklin, Wyoming; Roger E. Maloon, Fayetteville, all of Ohio

[73] Assignee: General Electric Company, Cincinnati, Ohio

[21] Appl. No.: 755,399

[22] Filed: Sep. 5, 1991

[51] Int. Cl.[5] ..... F01D 9/00; F03B 3/18

[52] U.S. Cl. ..... 415/196; 415/189; 415/209.2; 415/209.3

[58] Field of Search ..... 415/209.2, 209.3, 208.1, 415/189, 196

[56] References Cited

U.S. PATENT DOCUMENTS

| | | | |
|---|---|---|---|
| 2,833,463 | 5/1958 | Morley | 415/209.3 |
| 2,928,586 | 3/1960 | Hart | 415/209.2 |
| 2,980,396 | 4/1961 | Movsesian | 415/189 |
| 3,085,398 | 4/1963 | Ingleson | 415/189 |
| 3,365,173 | 1/1968 | Lynch et al. | 415/209.3 |
| 3,542,483 | 11/1970 | Gagliardi | 415/136 |
| 3,752,598 | 8/1973 | Bowers et al. | 415/173 |
| 3,910,716 | 10/1975 | Roughgarden et al. | 415/189 |
| 3,938,906 | 2/1976 | Michel et al. | 415/139 |
| 3,970,318 | 7/1976 | Tuley | 277/136 |
| 4,522,559 | 6/1985 | Burge et al. | 415/196 |
| 4,856,963 | 8/1989 | Klapproth | 415/189 |
| 5,022,818 | 6/1991 | Scalzo | 415/189 |

*Primary Examiner*—Edward K. Look
*Assistant Examiner*—Mark Sgantzos
*Attorney, Agent, or Firm*—Jerome C. Squillaro; John R. Rafter

[57] ABSTRACT

A stator vane liner assembly includes seal keys supported in slots in the ends of vane liner segments in an engine casing. Stationary vanes supported in the liner segments for directing an engine airflow are urged against the keys by the engine airflow gas loads. The seal keys engage the ends of adjacent vane liners for sealing, and prevent further motion of the vanes with respect to the liner segments due to the engine airflow gas loads. Secondary seal means can be slidably captured between the seal key and vane liner segment to prevent axial and radial leakage around the seal key. The liner assembly reduces leakage of engine airflow and helps to isolate the engine casing from the thermal effects of leakage of engine airflow.

20 Claims, 6 Drawing Sheets

FLOW ACTIVATED FLOWPATH LINER SEAL

This application is related to and incorporates by reference the following U.S. patent applications assigned to the General Electric Company: Flexible Three-Piece Seal Assembly, filed Jan. 17, 1991, Ser. No. 642,739, Kellock et al.; Heat Shield for Compressor/-Stator Structure, filed Jul. 9, 1991, Ser. No. 727,186, Plemmons et al.; and Vane Liner with Axially Positioned Heat Shields, filed Jul. 9, 1991, Ser. No. 727,182, Plemmons et al.

BACKGROUND OF THE INVENTION

This invention relates generally to gas turbine engines, and more particularly to an engine gas flow actuated seal and vane stop for a stator vane liner assembly.

Gas turbine engines typically include flowpath liners such as shrouds and stator vane liners which form an annular flowpath boundary for an engine working gas flow. Flowpath liners can be supported in an engine case structure, and can be segmented to accommodate differential thermal growth between the liner and the case structure. Seals are used between adjacent liners to restrict leakage of the engine gas flow between adjacent liners. Such leakage of the engine working flow reduces engine efficiency. In addition, leakage that impinges on the case can thermally damage the case, and leakage between the liners and the case can cause temperature gradients in the case which adversely affect rotor blade tip clearances. Where a case consists of two 180 degree halves bolted at a flanged horizontal splitline, sealing at the splitline is difficult, and leakage and impingement of the gas flow against the case flanges at the splitline is especially difficult to control.

U.S. Pat. No. 3,938,906 issued to Michel et al. disclose a slidable, spring loaded elongated seal 14 that extends in a tongue-in-groove manner from one turbine vane shroud to abut an end of an adjacent shroud. The mechanical spring is subject to failure due to mechanical fatigue, fretting, and wear in the hostile, high temperature environment of gas turbine engine, and adds complexity to the assembly. Further, any failure of the spring can result in loss of sealing and foreign object damage to downstream airfoils if broken spring pieces enter the engine working gas flow. The seal includes a retaining pin 18 and a slot 30 which can interrupt the sealing surface on seal 14 and provide a radial leakpath across the seal. A single seal member 34 for controlling axial flow leakage around the elongated seal 14 is disposed in radial slots 36 and 38 extending through the radial thicknesses of both the seal 14 and the shroud, thereby forming a continuous radial leakage path from the engine flowpath.

U.S. Pat. No. 2,833,463 issued to Morley shows blade rings 16 and stator blades 21 located circumferentially by washers secured by screws to the flanges of casing halves. The washers prevent motion of the stator blades 21 in the blade rings when the blades are acted on by the engine gas flow. Other designs can include stakes or ribs fixed to the case for preventing rotation of the blades in the blade rings or liners during engine operation. Such bolted or fixed attachments can introduce stress concentrations into the case structure.

FIG. 2 shows a known vane liner assembly with separate flexible spline seals extending between adjacent vane liners and seated in oppositely facing grooves in the adjacent vane liners. Separate seal pieces can become worn or break and enter the flowpath as foreign objects. U.S. Pat. No. 3,542,483 to Gagliardi shows two semicircular blade ring halves with axial and radial seal members extending between adjacent vane segments. However, in practice it is often not practical to include seals at the splitline between two 180 degree case halves. Simultaneous alignment of the grooves in the vane liners and the separate seals when the two case halves are being assembled is difficult, is labor intensive, and can result in damaged seals.

OBJECTS OF THE INVENTION

Accordingly, one object of the present invention is to provide a flowpath liner seal for effective sealing between flowpath liner segments, including the flowpath liner segments at a casing splitline, without the need for labor intensive alignment of seals and grooves at assembly of the case halves.

Another object of this invention is to provide a flowpath liner seal member inseparably connected to a flowpath liner segment.

Another object of this invention is to provide a seal member supported on a flowpath liner segment and actuated by engine working gas flow forces.

Another object of this invention is to provide a vane liner seal member supported on a stator vane liner segment and actuated by engine working gas flow forces on one or more vanes supported in the vane liner.

Another object of this invention is to provide a combined vane liner seal and vane stop.

Another object is to provide a seal actuated by a force which increases as engine airflow pressure and temperature increases.

Another object of this invention is to provide a vane liner seal member having an unbroken sealing surface.

Still another object of this invention is to provide a vane liner seal member and flexible secondary spline or feather seal means inseparably captured between the seal member and the vane liner to prevent axial and radial flow around the vane liner seal member.

SUMMARY OF THE INVENTION

Briefly, a stator vane liner assembly includes vanes slidably supported in vane liners and a seal key associated with each vane liner. The seal key includes an elongated head portion slidably supported in an end slot in the vane liner, and a tail portion extending between the vane liner and at least one vane to inseparably capture the seal key in the liner end slot by means of a pin and groove combination. During engine operation gas loads on the airfoils of the vanes supported in the liner urge a vane surface against the seal key. The seal key is urged out of the end slot to sealingly engage an adjacent vane liner and restrict further circumferential movement of the vanes in the liner due to engine airflow gas loads. The force by which the seal key is sealingly urged against the adjacent liner increases as the engine airflow pressure and temperature increase.

Secondary flexible spline or feather seals can be inseparably captured between the vane liner and seal key to restrict axial and radial leakage around seal key, without providing a radial leakpath through the seal key or vane liner segment.

BRIEF DESCRIPTION OF THE DRAWINGS

Other objects and advantages of the invention will become apparent from the following detailed description and drawings, wherein.

DESCRIPTION OF A PREFERRED EMBODIMENT

Figure 1:
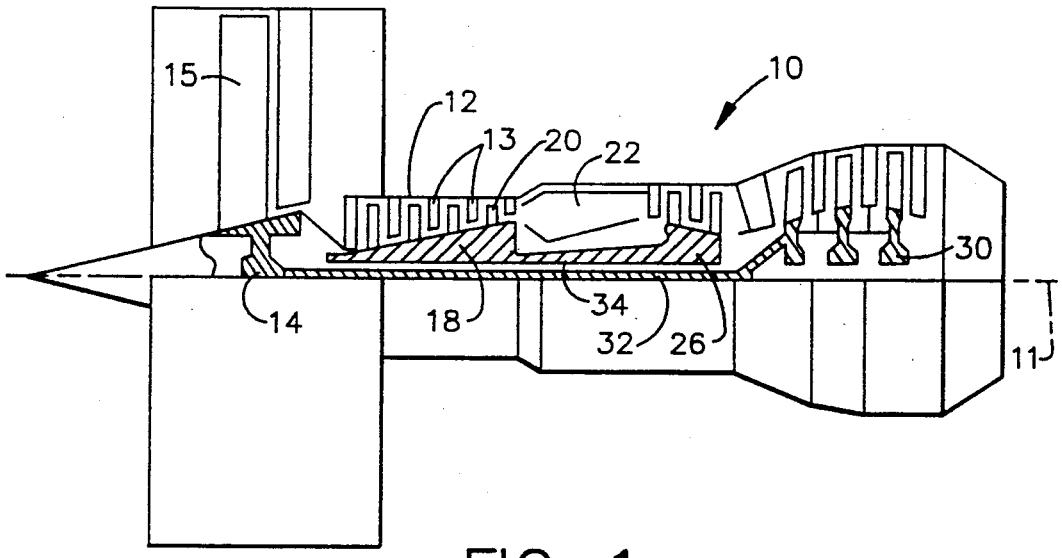
FIG. 1 (PRIOR ART)
FIG. 1 is a cross-sectional illustration of a gas turbine engine.

FIG. 1 illustrates a longitudinal sectional schematic view of a known high bypass gas turbine engine 10. Engine 10 includes a bladed fan rotor assembly 14 connected to a low pressure turbine rotor assembly 30 by a low pressure shaft 32, and a bladed compressor rotor assembly 18 connected to a high pressure turbine rotor assembly 26 by high pressure shaft 34. The rotor assemblies and shafts 32 and 34 are concentrically supported within engine stationary structures for rotation about an engine axis 11. A combustor 22 is typically supported upstream of the high pressure turbine rotor assembly 26. Compressed air exiting compressor rotor assembly 18 is mixed with fuel and burned in combustor section 22 to provide a combustor gas flow for expansion in the high pressure turbine 26. The resulting rotation of high pressure turbine rotor assembly 26 drives compressor rotor assembly 18 via shaft 34. The combustor gases exiting high pressure turbine rotor assembly 26 are further expanded in low pressure turbine rotor assembly 30 to drive the fan rotor assembly 14 and blades 15 via shaft 32, all in a manner well known to those skilled in the art of gas turbine design.

Figure 2:
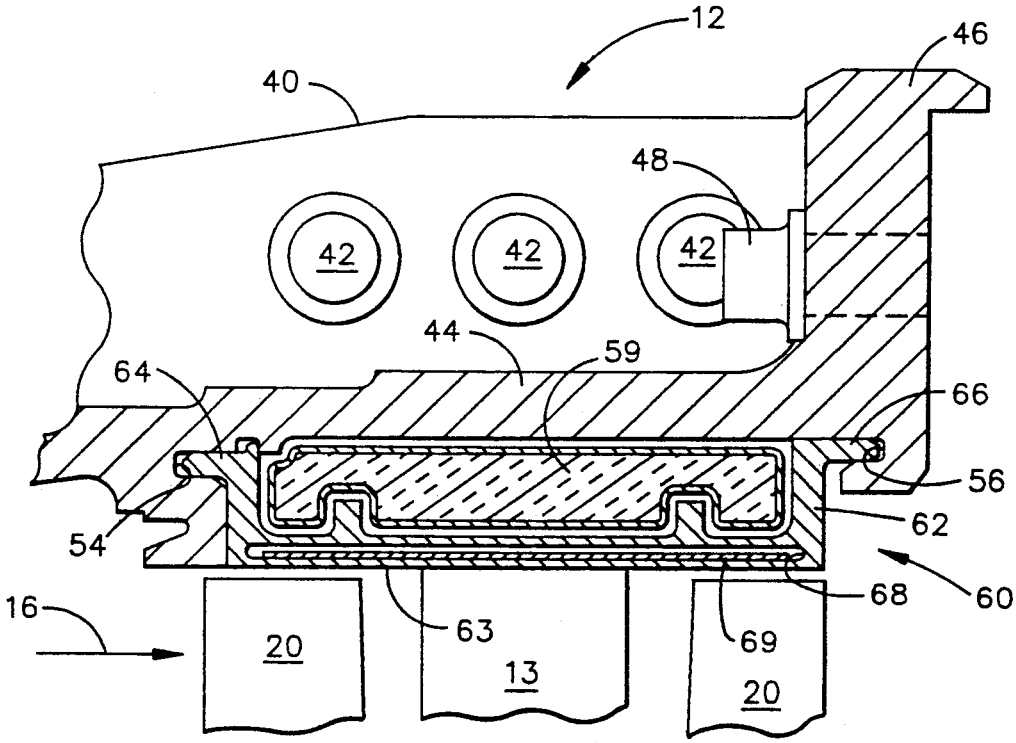
FIG. 2 (PRIOR ART)
FIG. 2 is a partial cross-sectional illustration of a known compressor vane liner assembly.

The compressor rotor assembly 18 includes rotating rows of blades 20 extending radially outwardly toward a stationary compressor case structure 12 to compress an annular engine working gas flow 16 (FIG. 2). Rows of stationary compressor vanes 13 extend radially inward intermediate the rows of rotating blades 20. The stationary vanes 13 direct engine air flow 16 from the adjacent upstream row of rotating blades 20 into the adjacent downstream row of rotating blades 20.

FIG. 2 illustrates a longitudinal sectional schematic view of a known compressor stator vane assembly 60 supported in the compressor case structure 12. The compressor case structure 12 can include two 180 degree case halves, each case half including a case wall 44 extending circumferentially 180° between horizontal flanges 40, and extending axially from an upstream end to a downstream end which can include a circumferentially extending aft flange 46. The compressor case halves can be bolted together at the horizontal flanges 40 by bolts 42, and bolted to a downstream case structure (not shown) by bolts 48 extending through aft flange 46, all in a manner well known by those skilled in the art.

The assembly 60 can include a plurality of circumferentially extending vane liner segments 62 supported in the case wall 44 of each case half. Each vane liner segment 62 includes an inner surface 63 which can form a portion of the the flowpath boundary for annular engine air flow 16, so that the vane liner segments 62 act as flowpath liners for engine flow 16. Liner segments 62 also include one or more vanes 13 which can be fixedly attached to the segment 62, as by brazing, or slidably mounted in segment 62, as shown in U.S. Pat. No. 2,833,463. Each liner segment 62 can include circumferentially and axially extending legs 64 and 66 which slide in circumferentially extending grooves 54 and 56 machined in case wall 44. Each liner segment 62 can be inserted into a case half, postioned circumferentially in the case half along grooves 54 and 56, and then fixed relative to the case half with bolts, stakes, or other known means. Sealing between adjacent vane liner segments is provided by separate, flexible spline or feather seals 69 extending into oppositely facing slots 68 in adjacent vane liner segments. Insulators 59 can be located between the vane liner segments and the case to thermally isolate the case from engine flow 16. Insulators 59 can be fiber blankets, or preferably the insulators of application Ser. Nos. 727,186 and 727,182 cross-referenced above.

Figure 3:
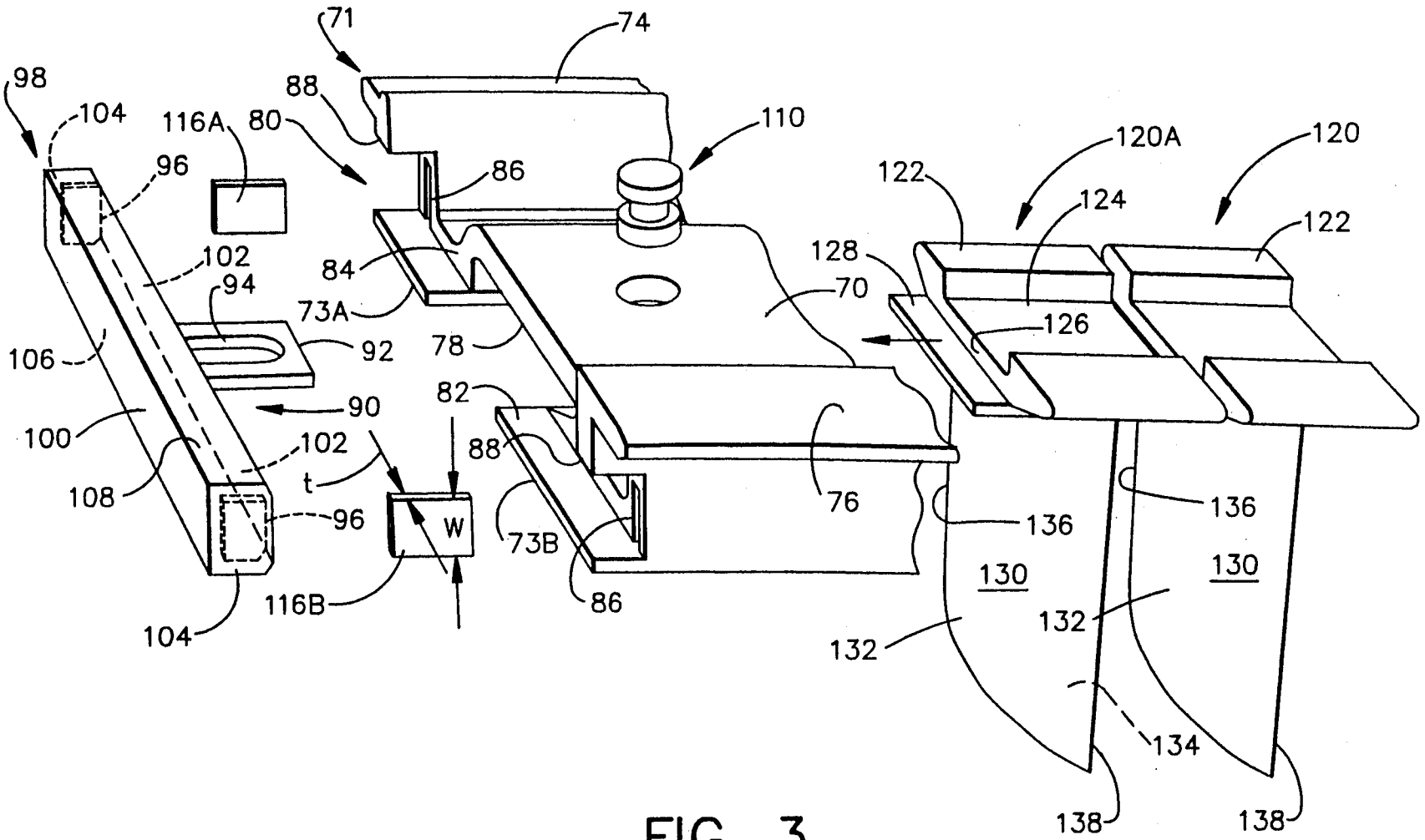
FIG. 3 is a partial exploded schematic illustration of a vane liner assembly in accordance with one embodiment of the present invention.
Figure 4:
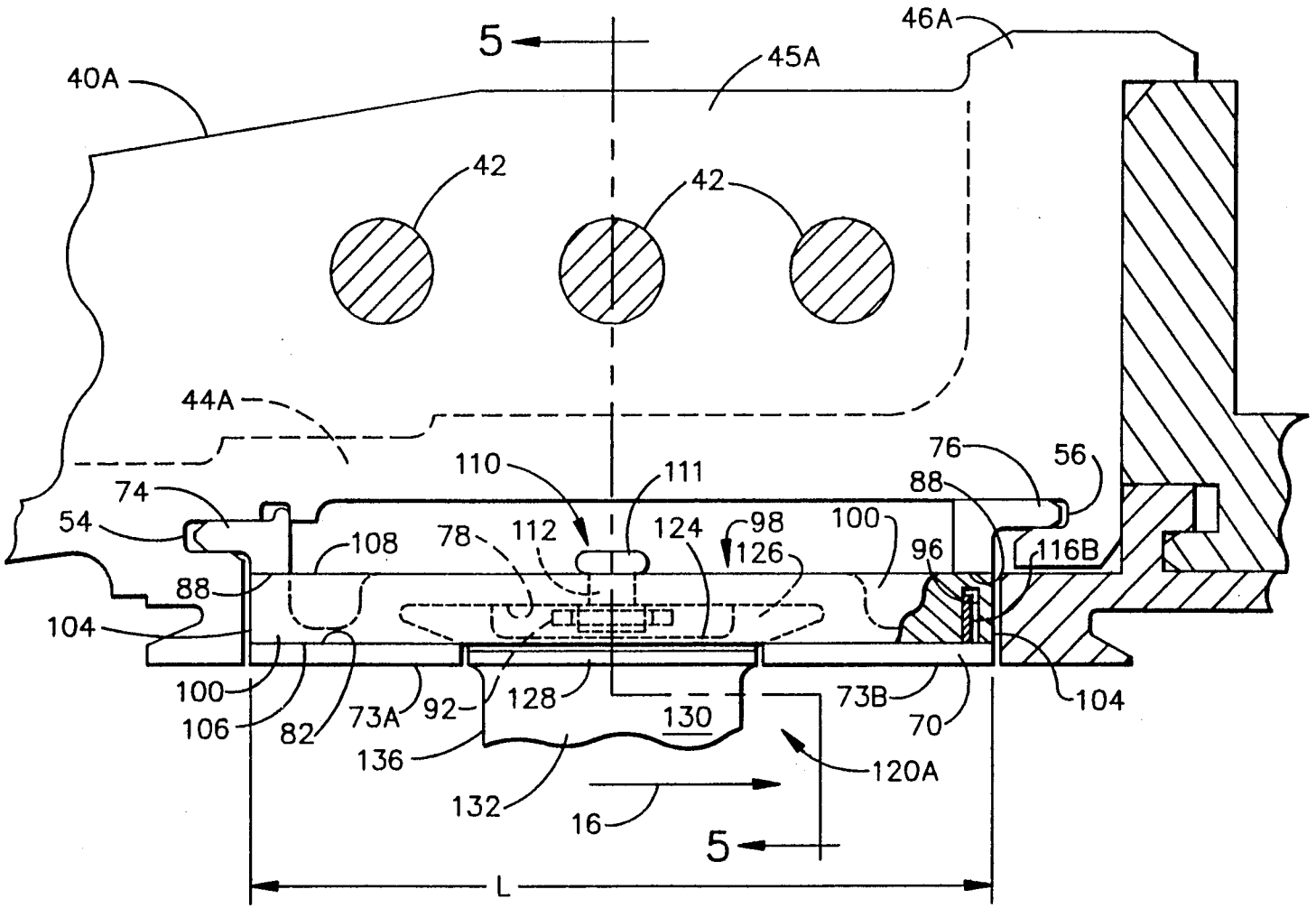
FIG. 4 is a a schematic illustration of the vane liner assembly of FIG. 3 positioned at a compressor case splitline, with one case half removed for clarity.
Figure 5:
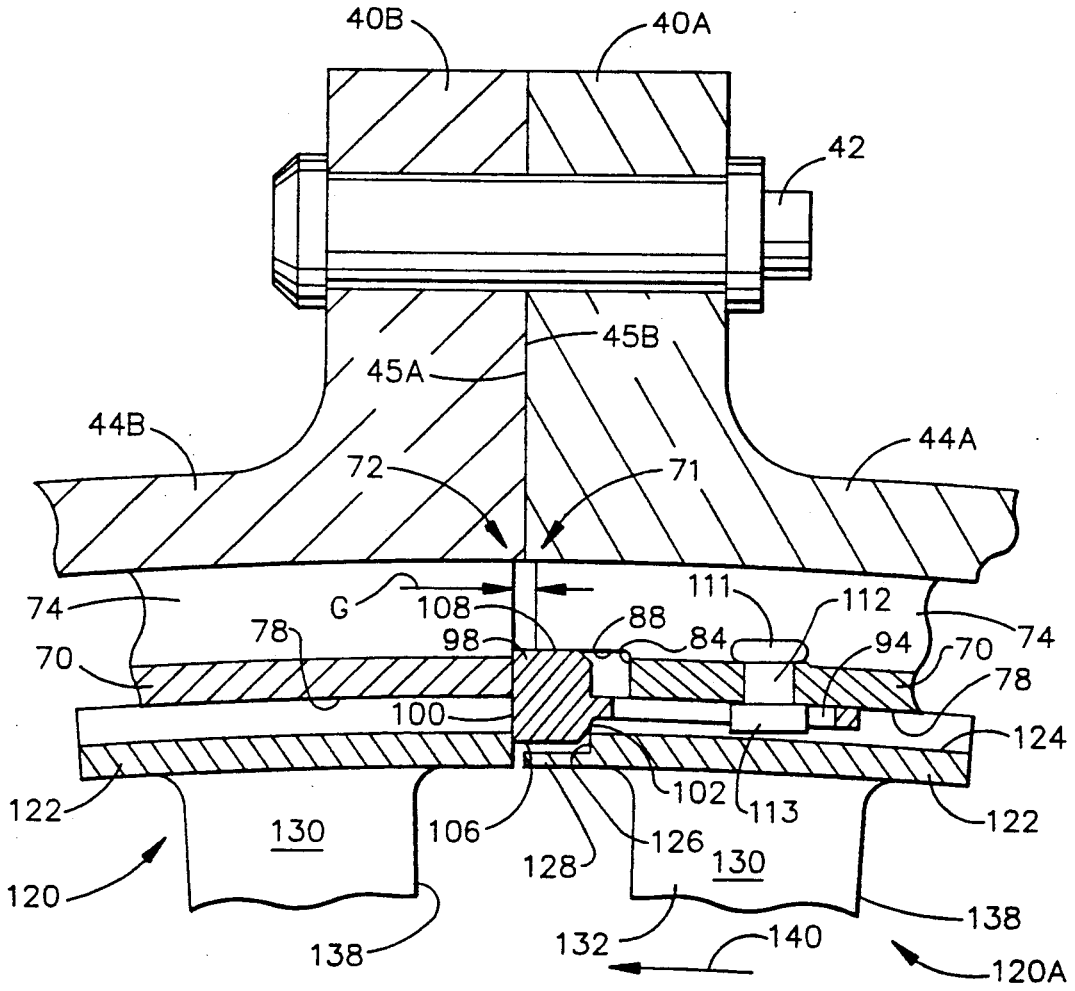
FIG. 5 is a schematic illustration of the vane liner assembly taken along 5—5 in FIG. 4, but with both case halves shown.

FIGS. 3, 4, and 5 illustrate a vane liner assembly according to the present invention. Referring to FIG. 3, the vane liner assembly includes a plurality of flowpath liners, such as stator vane liner segments 70; a seal member, or seal key 90 supported for movement on each liner segment 70; and an engine flow responsive member extending into the engine airflow, such as a vane 120A, actuated by engine airflow 16 for urging the seal key 90 into sealing engagement with an adjacent liner segment.

Liner segments 70 are supported in case wall 44 by liner legs 74 and 76 which slide in case grooves 54 and 56. FIGS. 4 and 5 illustrate vane liners 70 at the junction of two case halves with mating flange surfaces 45A and 45B on horizontal flanges 40A and 40B. Case wall 44A and aft flange 46A are shown in phantom in FIG. 4, and case walls 44A and 44B on adjacent case halves are shown in FIG. 5.

Liner segments 70 extend circumferentially in case walls 44A and 44B from a first end 71 to a second end 72, with first and second ends 71 and 72 of adjacent liners spaced apart by a gap G to accommodate thermal growth. First and second ends 71 and 72 of adjacent liners at the the horizontal casing splitline are shown in FIG. 5.

Insulators 59 (not shown for clarity) can be supported for case thermal isolation, as between the vane liner segments 70 and the case wall 44, as shown in application Ser. Nos. 727,186 and 727,182 cross-referenced above.

Each liner segment can include a radially inward facing upstream and downstream surfaces 73A and 73B that form a portion of an annular flowpath boundary for engine flow 16. Surfaces 73A and 73B can be separated by a circumferentially extending shouldered slot 78. Slot 78 slidably supports one or more vanes, such as vane 120A, which is closest to first end 71, and vane 120. The vanes include a root section 122 disposed in slot 78 and an airfoil section 130 extending into engine flow 16. Airfoil sections 130 include a leading edge 136, trailing edge 138, a generally convex suction surface 132, and a generally concave pressure surface 134.

Engine flow 16 passing over airfoil surfaces 132 and 134 exerts a force 140 (FIG. 5) on the airfoils tending to urge the vanes in shouldered slots 78 toward the first end 71 of each liner. As compressor speed increases, the velocity, temperature and pressure of engine flow 16 increases. The force 140 on airfoils 130 increases with compressor speed, and thus with the temperature and pressure of engine airflow 16.

The first end 71 of each liner 70 includes an end slot 80 which can be at least partially bounded by an inner surface 82, an outer surface 88, and a sidewall surface 84. The seal key 90 can include an elongated head portion 98 slidably supported in end slot 80, and a tail portion 92 extending from the head portion 98 intermediate the liner segment 70 and the root 122 of vane 120A. Root 122 of vane 120A can include a recess 124 to accommodate tail portion 92. A portion of root 122 on vane 120A adjacent to slot 80 is cut away to leave a vane ledge 128 and a seal key contact surface 126 on the side of the vane corresponding to the convex suction surface 132. Head portion 98 includes a sealing surface 100, inner and outer surfaces 106 and 108, end surfaces 104, and a vane contact surface 102 facing at least a part of surface 126.

Under the action of force 140 acting on the vanes 120 supported in slot 78, surface 126 on vane 120A abuts surface 102 on seal key 90 to urge sealing surface 100 into sealing engagement with the second end 72 of an adjacent liner segment 70. Surface 100 is urged more tightly against the adjacent vane liner end 72 as the compressor speed, pressure, and temperature increase. Vane ledge 128 extends inward of head portion 98 to provide a portion of the flowpath for engine flow 16, and is preferably closely spaced from, without contacting, the adjacent vane on the adjacent liner when seal surface 100 engages the adjacent liner. The seal key can thereby act as both a seal between adjacent liner segments 70, and as a stop to prevent further rotation of the vanes in liner shouldered slot 78 under the action of engine working gas flow forces 140.

A pin 110, which can be formed as a rivet in liner segment 70, extends from segment 70 and can include a head 111, a shank 112, and a cylindrical end 113. The cylindrical end 113 can extend into a groove 94 in the seal member tail portion 92 to inseparably connect the seal key 90 to the liner segment 70. The groove 94 and pin 110 are sized to retain seal key 90 in end slot 80 during handling and assembly of liners 70 in the engine case, but do not restrict motion of seal key 90 once liner segments 70 are installed in the engine case. Alternatively, the seal key 90 could be hinged to liner 70 and pivoted into engagement with the adjacent liner by vane 120A.

The sealing surface 100 is preferably a continuous surface for continuous, unbroken contact with the adjacent vane liner, and is uninterrupted by groove 94 in tail portion 92. The sealing surface 100 preferably extends the entire flowpath width, L, of the liner segments, where L is defined by the upstream and downstream ends of liner inner surfaces **73*a* and 73*b* (FIG. 4**).

The vane liner assembly preferably includes at least two secondary seal means extending radially and circumferentially, such as upstream spline seal **116*a* and downstream spline seal 116*b*. Seals 116 restrict axial flow in slot 80 between seal key 90 and the vane liner when the seal key is urged against adjacent liner end 72. The pressure in flow 16 generally increases from the upstream surface 73*a* to the downstream surface 73*b*. Seal 116*b* restricts leakage entering slot 80 at the downstream end of surface 73*b* from flowing axially in slot 80 to re-enter flow 16 at the upstream end of surface 73*a*. Seal 116*a* restricts leakage entering slot 80 between ledge 128 and seal key 90 from flowing axially to re-enter flow 16 at the upstream end of surface 73*a***.

The spline seals 116 are inseparably captured in oppositely facing slots 96 and 86 in head portion 98 and end slot surface 84, respectively. The seal key and seals 116 can be inseparably connected to the vane liner by first loading secondary seals 11 into their respective vane liner slots 86. Seal key slots 96 can then be aligned with seals 116 so that seal key 90 can slide into vane liner slot 80. The seal key and secondary seals 116 are then inseparably captured in vane liner 70 by passing pin 110 through liner 70 and into groove 94 in the seal key tail portion, thereby allowing limited sliding of key 90 in slot 80 without loss of seals 116 or key 90 from slot 80. Oppositely facing slots 96 do not extend through the full radial thickness of head portion 98, each slot 96 being closed at either or both of its radial inner and outer ends. Likewise, slots 86 do not extend through the full thickness of liner 70, each slot 86 also having at least one closed end. Therefore, slots 96 and 86 do not provide a radial leakpath through the vane liner.

The seals 116 should be flexible to sealingly conform to slots 86 and 96, and to accommodate any misalignment of slots 86 and 96 due to manufacturing tolerances. Accordingly, seals 116 should have a high width to thickness ratio, w/t (FIG. 3), where w/t is preferably greater than 7 and t is preferably no more than about 0.020 inch.

The gap G in FIG. 5 can be about 0.050 inch where a relatively large number of liner segments form the annular flowpath boundary (e.g., ten 36° segments). The gap G between liner segments can be larger to accommodate thermal growth where a small number of liner segments form the annular flowpath boundary.

Figure 6:
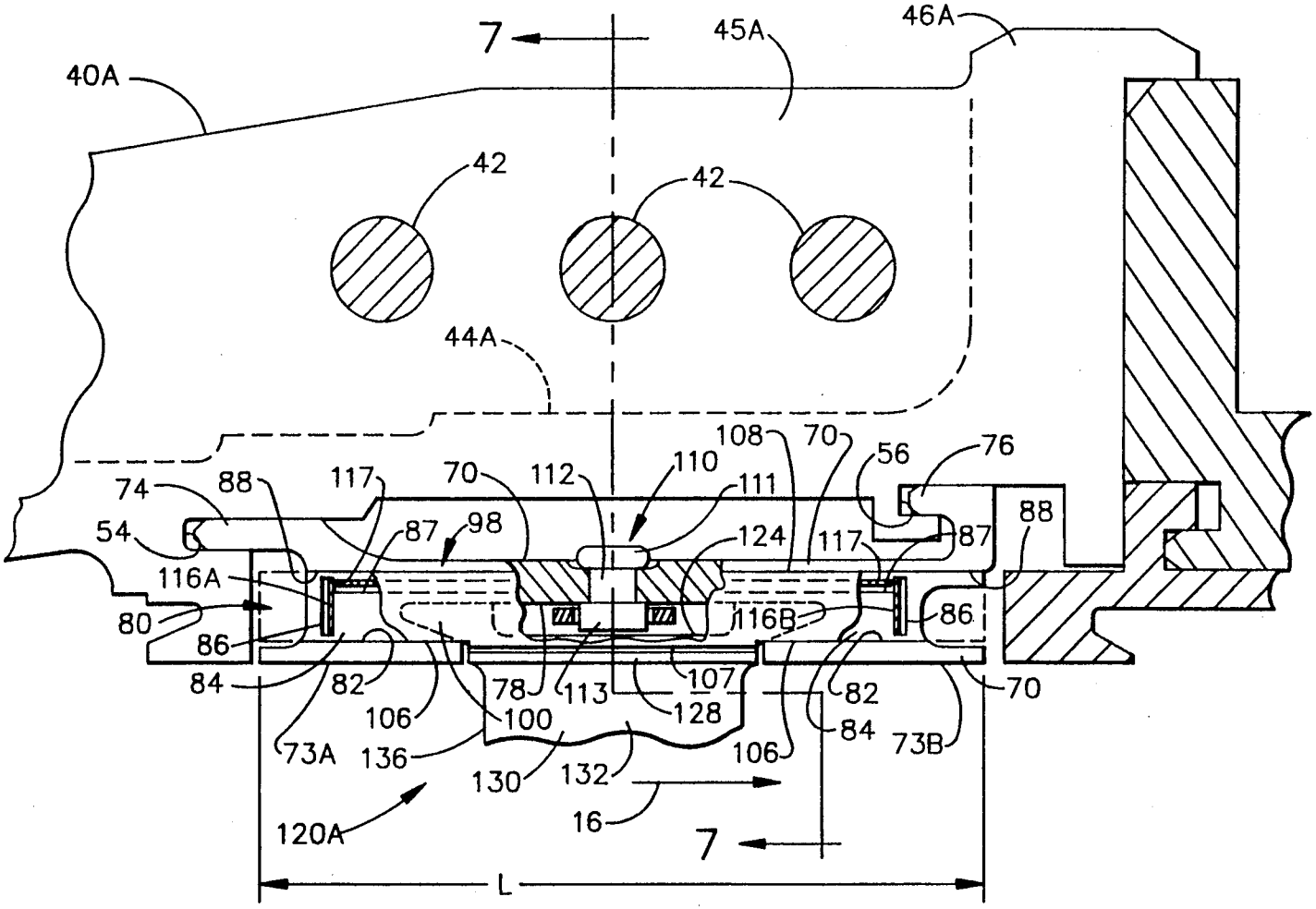
FIG. 6 is a schematic illustration of a second embodiment of the vane liner assembly positioned at a compressor case splitline, with one case half omitted for clarity.
Figure 7:
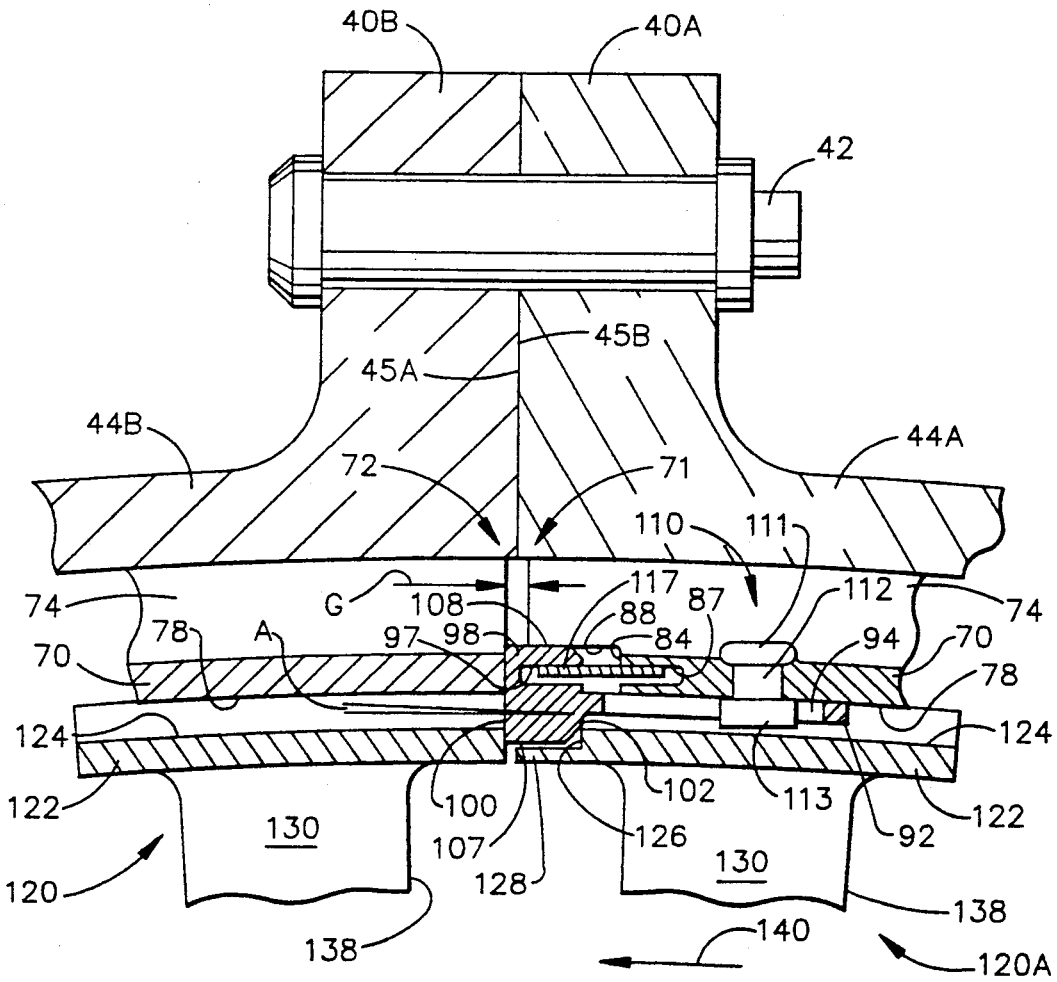
FIG. 7 is a schematic illustration of the vane liner assembly taken along 7—7 in FIG. 6, but with both case halves shown.

FIGS. 6 and 7 show a second embodiment where the gap G between liner segments may be large (e.g., more than 0.100 inch), as where there are fewer liner segments (e.g., four 90° segments). The tail portion 92 of seal key 90 can be angled with respect to sealing surface 100 by an angle A (FIG. 7) of about three to four degrees to ensure sealing surface 100 will seat flat against the adjacent liner second end 72 when seal key 90 extends from end slot 80.

A third secondary seal means extending axially and circumferentially intermediate seals 116, such as spline seal 117, can be captured in oppositely facing slots 97 and 87 in head portion 98 and end slot surface 84, respectively. Seal 117 can extend axially, intermediate the upstream and downstream secondary seal means **116*a* and 116*b*. Seal 117 restricts radial leakage between seal key 90 and the liner segment first end 71 when key 90 is extended into contact with adjacent liner second end 72. Together, secondary seals 116 and 117 restrict axial and radial leakage flow around the seal key 90. FIG. 6 shows the upstream and downstream ends of key head portion 98 in phantom to illustrate the positions of seals 116 and 117 in liner 70**.

The elongated head portion 98 shown in FIGS. 6 and 7 can further include a protrusion 107 extending radially inwardly from surface 106 to be closely spaced from vane ledge 128. Protrusion 107 restricts leakage flow between ledge 128 and seal 90.

The seal 90 and liner 70 are preferably manufactured from high temperature nickel based alloy, such as an Inconel 718 forging. Secondary seals 116, 117 can be formed from a high temperature alloy; for instance, a cobalt based alloy such as L-605 for good lubricity.

While this invention has been described with respect to sealing at the junction of two compressor case halves, it is equally suitable for sealing between any two adjacent compressor stator vane liners. Further, the invention could be adapted for use with flowpath liner segments in other areas of the engine, such as vane assemblies in the turbine sections.

Thus, while this invention has been disclosed and described with respect to representative embodiments, it will be understood by those skilled in the art that various changes and modifications may be made without departing from the spirit and scope of the invention as set forth in the following claims.

WHAT IS CLAIMED:

1. A flowpath liner assembly for use in a gas turbine engine comprising:
(a) a plurality of spaced apart flowpath liner segments supported in an engine casing and forming a flowpath boundary for an engine gas flow;
(b) a seal member movably supported on at least one of the liner segments; and
(c) an engine flow responsive member actuated by the engine gas flow for urging the seal member into sealing engagement with an adjacent liner segment.

2. The liner assembly recited in claim 1, wherein the seal member is slidably supported in the liner segment for translation toward an adjacent liner segment.

3. The liner assembly recited in claim 1, further including at least two secondary seal means captured between the seal member and the liner segment.

4. The liner assembly recited in claim 1, further including secondary seal means restricting both axial and radial leakage around the seal member.

5. The liner assembly recited in claim 1 wherein the flow responsive member actuated by the gas flow includes a vane mounted on the liner segment and having an airfoil for extension into the engine gas flow.

6. The liner assembly recited in claim 5, wherein the seal member is slidably supported in the liner segment, and wherein the seal member includes surface means for engaging the vane and surface means for engaging the adjacent liner segment.

7. The liner assembly recited in claim 6, wherein the surface means for engaging the adjacent liner segment is continuous.

8. The liner assembly recited in claim 5, wherein the seal member is slidably supported in a slot in an end of the liner segment for translation from a first retracted position to a second sealing position, the assembly including upstream and downstream secondary seal means captured between the seal member and liner.

9. The liner assembly recited in claim 8, further including a seal member elongated head portion with a continuous sealing surface slidably supported in the slot in the end of the liner segment, a seal member tail portion extending from the head portion intermediate the vane and the liner segment, and a positioning pin extending from the liner segment into an elongated groove disposed in the seal member tail portion.

10. A stator vane assembly for use in a gas turbine engine comprising:
(a) a plurality of vane liner segments supported in an engine casing and forming an annular flowpath boundary for an engine gas flow;
(b) a circumferentially extending shouldered slot in each liner extending from a liner first end to a liner second end;
(c) at least one vane slidably mounted in each liner shouldered slot, each vane including a root section disposed in the shouldered slot and an airfoil section extending into the gas flow; and
(d) a seal member movably supported in an end slot in the first end of each liner, each seal member including a contact surface engageable with a vane surface and a sealing surface engageable with the second end of an adjacent liner segment.

11. The stator vane assembly recited in claim 10, wherein the seal member is slidably supported in the end slot.

12. The stator vane assembly recited in claim 10, including means for inseparably connecting the seal member to the vane liner segment.

13. The stator vane assembly recited in claim 10, wherein the seal member sealing surface is a continuous surface extending substantially the entire width, L, of the vane liner segment.

14. The stator vane assembly recited in claim 10, wherein the seal member includes an elongated head portion, a tail portion extending from the head portion intermediate the vane root and vane liner segment, and a pin extending from the vane liner segment into a groove in the tail portion.

15. The stator vane assembly recited in claim 10, including at least one upstream secondary seal means upstream of the liner shouldered slot, at least one downstream secondary seal means downstream of the liner shouldered slot, and at least one secondary seal means extending axially intermediate the upstream and downstream secondary seal means, the secondary seal means restricting axial and radial leakage flow around the seal member, each secondary seal means extending into oppositely facing slots in a vane liner end slot surface and the seal member, and slidably captured between the seal member and the vane liner.

16. The stator vane assembly recited in claim 10, wherein the seal member is urged into sealing engagement with the adjacent vane liner segment by circumferential motion of the vane within the shouldered slot, and wherein the seal member prevents further circumferential motion of the vane upon engaging the adjacent vane liner.

17. A method of sealing gaps between flowpath liner segments forming an annular boundary of a gas flow in a gas turbine engine, the method including the steps of:
(a) movably supporting a seal member on a flowpath liner segment;
(b) extending a member into the gas flow;
(c) transmitting gas loads from the extending member to the seal member; and
(d) urging the seal member into sealing engagement with an adjacent flowpath liner segment.

18. The method of claim 17 including the step of transmitting a force to the seal member from at least one vane movably supported on the liner segment, the vane having an airfoil extending into the gas flow.

19. The method of claim 17, including the step of movably capturing secondary seals between the seal member and the flowpath liner segment to restrict both axial and radial leakage flow around the seal member.

20. The method of claim 18, including the step of stopping at least one vane against the seal member to restrict further movement of the vane with respect to the liner segment upon sealing engagement of the seal member with the adjacent liner segment.

* * * * *